US009550646B2

(12) United States Patent
Horaguchi

(10) Patent No.: US 9,550,646 B2
(45) Date of Patent: Jan. 24, 2017

(54) MEDIA CONVEYANCE CONTROL METHOD AND PRINTER

(71) Applicant: Seiko Epson Corporation, Tokyo (JP)

(72) Inventor: Norio Horaguchi, Kamiina-gun (JP)

(73) Assignee: Seiko Epson Corporation, Tokyo (JP)

( * ) Notice: Subject to any disclaimer, the term of this patent is extended or adjusted under 35 U.S.C. 154(b) by 204 days.

(21) Appl. No.: 14/579,657

(22) Filed: Dec. 22, 2014

(65) Prior Publication Data

US 2015/0175374 A1 Jun. 25, 2015

(30) Foreign Application Priority Data

Dec. 20, 2013 (JP) ..... 2013-263494

(51) Int. Cl.

| | |
|---|---|
| ***B41J 29/38*** | (2006.01) |
| ***B65H 23/185*** | (2006.01) |
| ***B65H 23/182*** | (2006.01) |
| ***B41J 11/42*** | (2006.01) |
| ***B41J 15/16*** | (2006.01) |

(52) U.S. Cl.

CPC ..... *B65H 23/185* (2013.01); *B41J 11/42* (2013.01); *B41J 15/165* (2013.01); *B65H 23/1825* (2013.01); *B65H 2404/1521* (2013.01); *B65H 2404/20* (2013.01); *B65H 2511/214* (2013.01); *B65H 2513/11* (2013.01); *B65H 2553/51* (2013.01); *B65H 2557/264* (2013.01); *B65H 2801/15* (2013.01)

(58) Field of Classification Search

CPC ..... B41J 15/005; B41J 15/16; B41J 15/165; B41F 33/18; B65H 23/042; B65H 23/044; B65H 23/063; B65H 23/18; B65H 23/1888; B65H 63/02; B65H 2511/112; B65H 2220/01; B65H 2220/02

See application file for complete search history.

(56) References Cited

U.S. PATENT DOCUMENTS

2009/0260739 A1* 10/2009 Fischer ..... B41J 3/407 156/64

2012/0312855 A1 12/2012 Horaguchi

FOREIGN PATENT DOCUMENTS

JP 08-133540 A 5/1996
JP 2012-254862 A 12/2012

* cited by examiner

*Primary Examiner* — Julian Huffman
(74) *Attorney, Agent, or Firm* — Nutter McClennen & Fish LLP; John J. Penny, Jr.

(57) ABSTRACT

A printer 1 has a movable member 27 that can move following change in the tension on recording paper 3 between a roll paper compartment 7 and a conveyance mechanism 12 on the paper conveyance path 8. When recording paper 3 of which the end is glued to the core 2*a* of a paper roll 2 runs out, the tension on the recording paper 3 rises and the movable member 27 goes to a tension-side error determination range E1 in its range of allowable movement E0. When the movable member 27 is in the tension-side error determination range E1, the time the movable member 27 remains in the tension-side error determination range E1 is counted, and if this measured time exceeds an error determination time, an error detection unit 38 detects an error. No-paper errors can therefore be detected without using a dedicated sensor.

8 Claims, 5 Drawing Sheets

MEDIA CONVEYANCE CONTROL METHOD AND PRINTER

Priority is claimed under 35 U.S.C. §119 to Japanese Application No. 2013-263494 filed on Dec. 20, 2013, which is hereby incorporated by reference in its entirety.

BACKGROUND

1. Technical Field

The present invention relates to a media conveyance control method that can suppress variation in the tension on the medium when conveying a continuous medium delivered and conveyed from a roll, and to a printer.

2. Related Art

A printer that prints on continuous recording paper delivered from a paper roll according to the related art is described in JP-A-H08-133540, for example. The printer described in JP-A-H08-133540 has a conveyance mechanism that conveys recording paper through a conveyance path past a print position, and a media supply motor for rotating the paper roll. JP-A-H08-133540 also describes forming a loop in the recording paper between the conveyance mechanism and the paper roll, and having a loop sensor that detects whether or not the loop is appropriately formed. When conveyance of the recording paper starts, the media supply motor is driven to rotate the paper roll so that the loop is desirably formed, and thereby reduces the load on the conveyance mechanism.

If the tension on the recording paper varies due to change in the diameter of the paper roll, for example, slipping may occur between the conveyance mechanism and the recording paper, and the conveyance speed of the recording paper may change. Because variation in the conveyance speed can lead to a drop in print quality, suppressing variation in the tension on the recording paper while the recording paper is being conveyed in the printer is desirable.

To suppress variation in the tension on the recording paper while the recording paper is being conveyed, a movable member that can move following variation in the tension on the recording paper between the paper roll and the conveyance mechanism may be provided, and delivery and take-up of the recording paper from the paper roll may conceivably be controlled to keep the movable member positioned at a target position set in the range of movement of the movable member. This can be achieved by, for example, regularly determining the deviation in the position of the movable member from the target position while conveying the recording paper, and using feedback control of the media supply motor to rotate the paper roll to minimize the acquired deviation as it is detected.

When such a configuration is used, however, the power supply to the media supply motor increases when a no-paper error or other error occurs while conveying the recording paper, possibly causing the media supply motor to overheat. For example, when printing with recording paper that has the trailing end glued to the core of the paper roll, and the end of the recording paper is reached, the recording paper will be pulled by the conveyance mechanism in the conveyance direction D while the trailing end of the paper is pulled in the opposite direction as the conveyance direction D by the core of the paper roll, and the recording paper will become locked and not conveyed. When this happens, the movable member remains stuck at the end of its range of movement on the side where the tension on the recording paper increases, and the media supply motor is therefore driven to rotate the paper roll in the direction delivering the recording paper in order to return the movable member to the target position. Because the deviation in the position of the movable member does not decrease in this event, even more power is supplied to the media supply motor as time passes, and the media supply motor may overheat.

When printing with recording paper that does not have the trailing end glued to the core of the paper roll and the recording paper ends, the recording paper will unravel from the core near the trailing end of the paper, and the force pulling the recording paper in the opposite direction as the conveyance direction D will disappear. In this event, the movable member becomes stuck at the end of its range of movement on the side where the tension on the recording paper is low, and the media supply motor is driven to rotate the paper roll in the direction that takes up the recording paper in order to return the movable member to the target position. Because the deviation in the position of the movable member does not decrease in this event, even more power is supplied to the media supply motor as time passes, and the media supply motor may overheat.

Furthermore, if the recording paper jams while the recording paper is being conveyed and the portion of the recording paper that jammed pushes the movable member to the end of its range of movement, the deviation in the position of the movable member does not decrease, even more power is supplied to the media supply motor as time passes, and the media supply motor may overheat. The recording paper will also continue being delivered from the paper roll in this event because driving the media supply motor continues.

Driving the media supply motor under conditions that can lead to overheating can conceivably be avoided by providing the printer with dedicated sensors for detecting conveyance errors when the recording paper ends or a paper jam occurs, for example. However, providing such sensors increases the manufacturing cost accordingly.

SUMMARY

An objective of the present invention is therefore to provide a media conveyance control method that can detect when a conveyance error occurs with media delivered from a paper roll without using a dedicated sensor for error detection, and a printer.

To achieve the foregoing objective, one aspect of the invention is a media conveyance control method of a media conveyance device having a conveyance mechanism that conveys a continuous medium delivered from a roll, and a media supply motor that rotates the roll, including: positioning a movable member that moves in response to a change in the tension on the medium between the roll and the conveyance mechanism; setting a target position and an error determination range separated from the target position in the movable range of the movable member; acquiring a positional deviation of the movable member from the target position continuously or intermittently while conveying the medium by the conveyance mechanism; controlling driving the media supply motor based on the positional deviation to set the movable member to the target position; measuring the time the movable member remains in the error determination range after the movable member enters the error determination range; and determining if an error occurred based on the measured time.

This aspect of the invention determines if an error occurs based on the position of a movable member that moves in response to a change in the tension on the recording paper. More specifically, if the end of the medium is glued to the core of a paper roll, the medium becomes locked in a position where it cannot be conveyed, and the movable member becomes stuck in its range of movement where the tension on the recording paper is high. If the end of the medium separates from the roll, the movable member becomes stuck at the end of its range of movement where the tension on the recording paper is low. If the recording paper jams while the recording paper is being conveyed, the movable member is pushed to the end of its range of movement by the jammed recording paper. Therefore, by setting the end of the range of movement of the movable member in an error determination range, whether or not a no-paper error or a paper jam error occurs can be detected based on whether or not the movable member is in the error determination range. Providing a dedicated sensor for detecting no-paper errors or paper jam errors is therefore not necessary. The movable member may also momentarily go to the error determination range due to vibration of the printer. If the part of the medium wound on the roll momentarily does not separate from the roll, the tension on the medium increases and the movable member may momentarily go to the error determination range. In these events, the invention determines if an error occurred based on how long the movable member stays in the error determination range. Whether or not an error occurred can therefore be determined without including cases in which the movable member is momentarily in the error determination range.

Preferably, the error determination range is set to an end part of the direction of movement of the movable member in the movable range. This configuration enables easily detecting an error when the medium runs out or the medium is not conveyed.

Further preferably, an error determination time for detecting if an error occurred is preset; and an error is determined to have occurred when the measured time reaches the error determination time.

Yet further preferably, the error determination time is set to greater than or equal to 5 ms and less than or equal to 5 s. This configuration enables detecting an error in a relatively short time by detecting errors based on this error determination time. The media supply motor can therefore be prevented from overheating by stopping the media supply motor when an error is detected.

Another aspect of the invention is a printer including: a conveyance mechanism that conveys a continuous medium delivered from a roll; a media supply motor that rotates the roll; a movable member disposed movably between the roll and the conveyance mechanism following change in the tension on the medium; a detector that detects the position of the movable member; a control unit that continuously or intermittently acquires the positional deviation of the movable member to a target position set in the movable range of the movable member while conveying the medium by the conveyance mechanism, and controls driving the media supply motor based on the positional deviation to set the movable member to the target position; a movable member position determination unit configured to determine if the position of the movable member is in an error determination range set to a position in the movable range separated from the target position while the medium is being conveyed by the conveyance mechanism; a clock unit that measures the time the position of the movable member is in the error determination range; and an error determination unit configured to determine if an error occurred based on the measured time.

In this aspect of the invention the error determination unit determines if an error occurs based on the position of a movable member that can move following change in the tension on the recording paper. More specifically, if the medium becomes locked in a position where it cannot be conveyed, the movable member becomes stuck at the end of its range of movement where the tension on the recording paper is high. If the end of the medium separates from the roll, the movable member becomes stuck at the end of its range of movement where the tension on the recording paper is low. If the recording paper jams while the recording paper is being conveyed, the movable member is pushed to the end of its range of movement by the jammed recording paper. Therefore, by setting an error determination range including the end of the range of movement of the movable member, for example, the error determination unit can determine whether or not a no-paper error or a paper jam error occurs based on the movable member being in the error determination range. Providing a dedicated sensor for detecting no-paper errors or paper jam errors is therefore not necessary. The movable member may also momentarily go to the error determination range due to vibration of the printer. If the part of the medium wound on the roll momentarily does not separate from the roll, the tension on the medium increases and the movable member may momentarily go to the error determination range. In these events, the invention determines if an error occurred based on how long the movable member stays in the error determination range. Whether or not an error occurred can therefore be determined without including cases in which the movable member is momentarily in the error determination range.

In another aspect of the invention, the error determination range is preferably set to an end part of the direction of movement of the movable member in the movable range. This configuration enables easily detecting an error when the medium runs out or the medium is not conveyed.

Further preferably, an error determination time for detecting if an error occurred is preset, and the error determination unit determines an error occurred when the measured time reaches the previously set error determination time.

Yet further preferably, the error determination time is set to greater than or equal to 5 ms and less than or equal to 5 s. This configuration enables detecting an error in a relatively short time. The media supply motor can therefore be prevented from overheating by stopping the media supply motor when an error is detected.

EFFECT OF THE INVENTION

The invention enables detecting if an error occurs based on the position of a movable member that can move following change in tension on the recording paper. Errors occurring while conveying a medium delivered from a roll can therefore be detected without using a dedicated sensor.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures.

Figure 1:
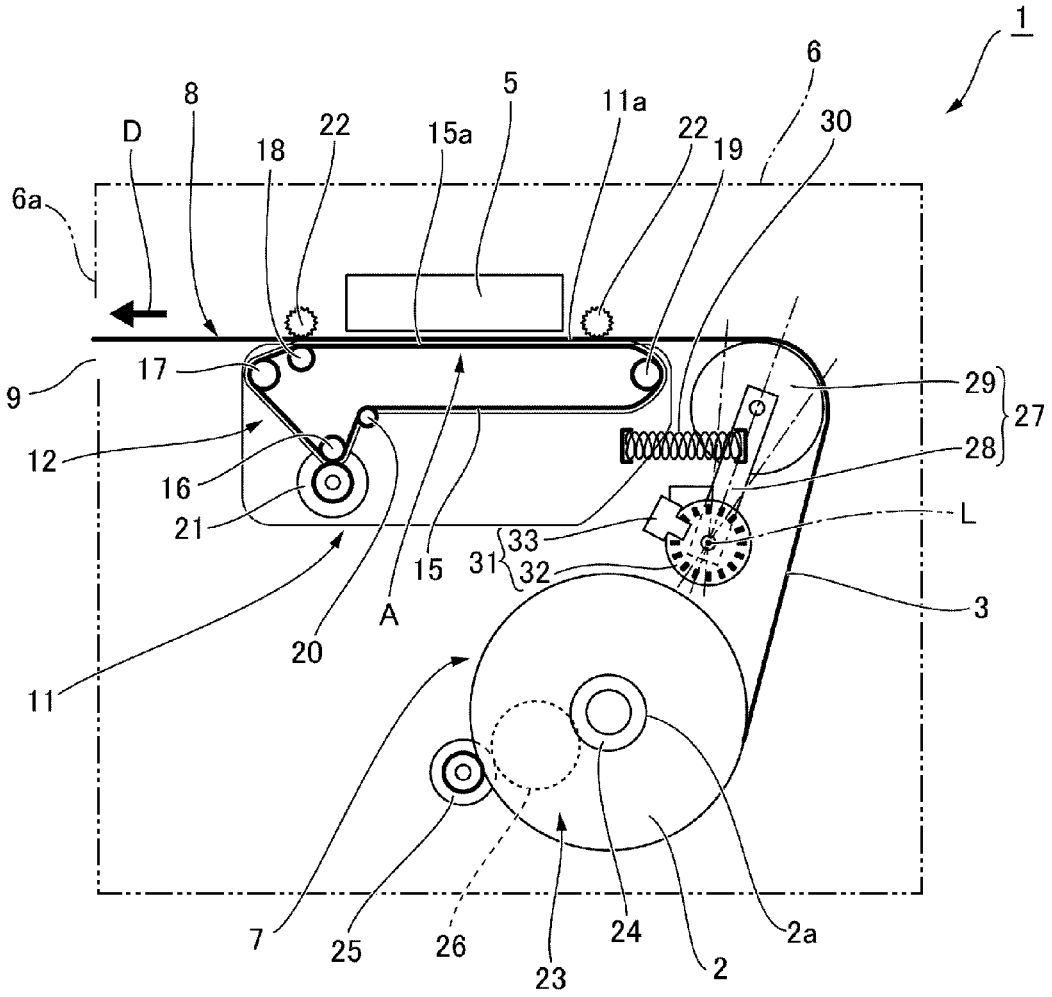
FIG. 1 illustrates the basic configuration of a printer according to the invention.
Figure 2:
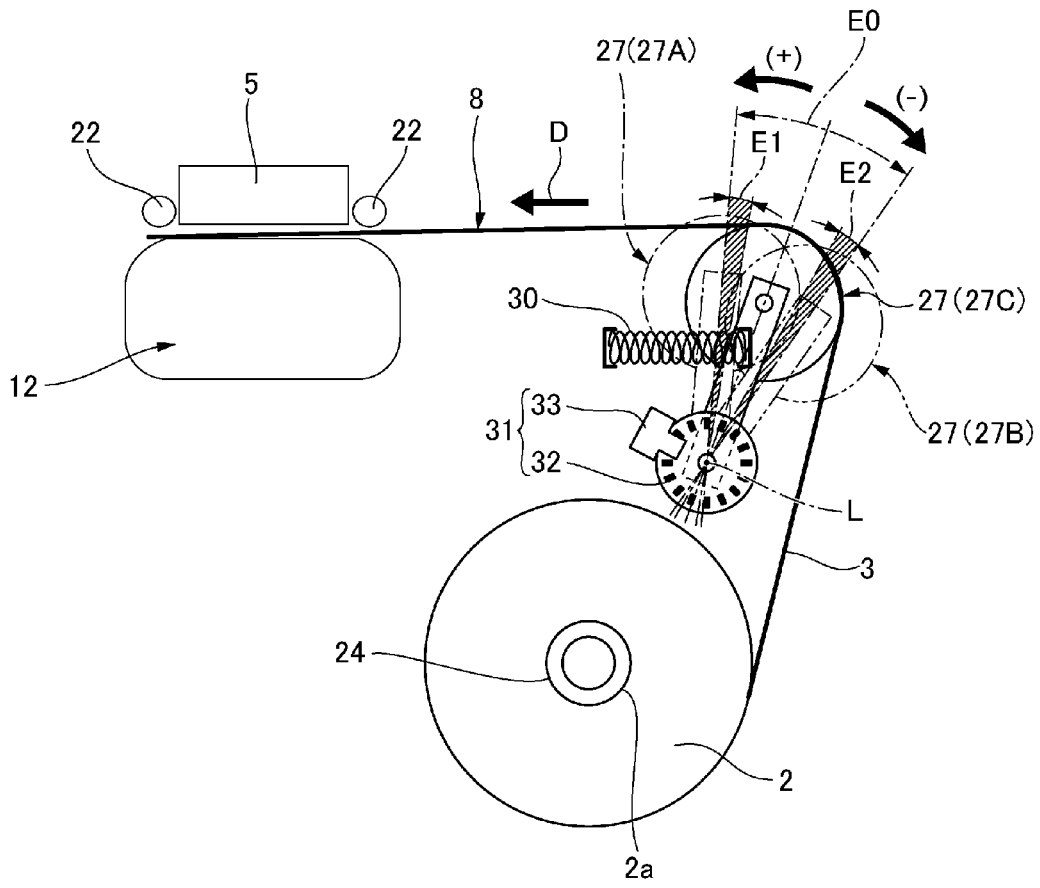
FIG. 2 illustrates the error determination range set in the allowable movement range of the movable member.

FIG. 1 illustrates the basic configuration of a printer according to the invention. FIG. 2 illustrates the error determination range set in the allowable movement range of the movable member.

The printer 1 in this example is a roll paper printer that prints on continuous recording paper (media) 3 delivered from a paper roll (roll) 2. The printer 1 in this example is also a line printer having an inkjet line head as the printhead 5. As shown in FIG. 1, the printer 1 has a roll paper compartment 7 that holds the paper roll 2, and a paper conveyance path 8 for conveying the recording paper 3 pulled from the paper roll 2, inside the printer case 6 indicated by an imaginary line. The paper conveyance path 8 goes from the roll paper compartment 7, past the print position A of the printhead 5, and to the paper exit 9 disposed at the top part of the front 6*a* of the printer case 6. The printhead 5 is disposed above the roll paper compartment 7.

A platen unit 11 is disposed below the printhead 5. The platen unit 11 has a platen surface 11*a* opposite the printhead 5 with a specific gap therebetween. The print position A is determined by the platen surface 11*a*. A conveyance mechanism 12 for conveying the recording paper 3 through the paper conveyance path 8 is also disposed to the platen unit 11.

The conveyance mechanism 12 includes an endless conveyance belt 15, a belt drive roller 16 on which the conveyance belt 15 is mounted, and a plurality of guide rollers 17 to 20. The conveyance mechanism 12 also includes a conveyance motor 21 as the drive source. Drive power from the conveyance motor 21 is transferred to the belt drive roller 16, and the conveyance belt 15 turns as a result of rotationally driving the belt drive roller 16.

The conveyance belt 15 has a flat belt portion 15*a* extending horizontally over the top of the platen unit 11. The flat belt portion 15*a* defines the platen surface 11*a*. Pinch rollers 22 are disposed to the flat belt portion 15*a* at the upstream end and the downstream end of the conveyance direction D. The pinch rollers 22 are pressed to the flat belt portion 15*a*, and the recording paper 3 is conveyed held between the pinch rollers 22 and the flat belt portion 15*a*.

A media supply mechanism 23 is disposed in the roll paper compartment 7. The media supply mechanism 23 includes a roll paper spindle 24 that holds the core 2*a* of the paper roll 2, and a supply motor (media supply motor) 25 for rotating the roll paper spindle 24. The supply motor 25 is driven by PWM control, and drive power therefrom is transferred through a gear train 26 to the roll paper spindle 24. When the supply motor 25 is driven and the roll paper spindle 24 turns, the paper roll 2 mounted on the roll paper spindle 24 rotates in unison with the roll paper spindle 24.

A movable member 27 that can move following change in the tension on the recording paper 3 is disposed to the paper conveyance path 8 between the roll paper compartment 7 and the conveyance mechanism 12.

The movable member 27 includes a slack lever 28 supported pivotably at the bottom end part around an axis of rotation L extending parallel to the width of the recording paper 3; and a slack roller 29 attached rotatably to the top end part of the slack lever 28. The slack lever 28 is urged to the back with a specific urging force by a compression spring 30. More specifically, the movable member 27 is urged by the compression spring 30 in the direction applying tension to the recording paper 3.

The recording paper 3 pulled up from the paper roll 2 stored in the roll paper compartment 7 travels around the slack roller 29, and continues to the front after curving to the front along the slack roller 29.

Note that instead of using a compression spring 30, a torsion spring may be disposed to the slack lever 28 at a position around the axis of rotation L, and the slack lever 28 urged by the torsion spring in the direction moving the slack roller 29 to the back.

A rotary encoder (detector) 31 that senses the position to which the movable member 27 (slack lever 28) moves is disposed near the axis of rotation L of the slack lever 28. The rotary encoder 31 includes an encoder disc 32 that rotates in unison with the slack lever 28 around the axis of rotation L, and a detection unit 33 disposed at a fixed position opposite the outside edge of the encoder disc 32. The current position of the movable member 27 is output from the detection unit 33.

The movable member 27 moves between a tension limit position 27A where the slack lever 28 is raised to a nearly vertical position, and a slack limit position 27B where the slack lever 28 is at an angle to the back. The distance between the tension limit position 27A and the slack limit position 27B is therefore the allowable movement range (movable range) E0 of the movable member 27. The tension limit position 27A is closer to the front than the slack limit position 27B. A target position 27C is set in the middle of the direction of movement of the movable member 27 through the allowable movement range E0. The target position 27C is the target position where the movable member 27 is to be held while the recording paper 3 is being conveyed.

An error determination range for detecting an error occurred is set in the allowable movement range E0. This error determination range is set to a position separated from the target position 27C. Two error determination ranges are set in this example, a tension-side error determination range E1 set to a specific angular range around the axis of rotation L including the tension limit position 27A, and a slack-side error determination range E2 set to a specific angular range around the axis of rotation L including the slack limit position 27B.

Control System

Figure 3:
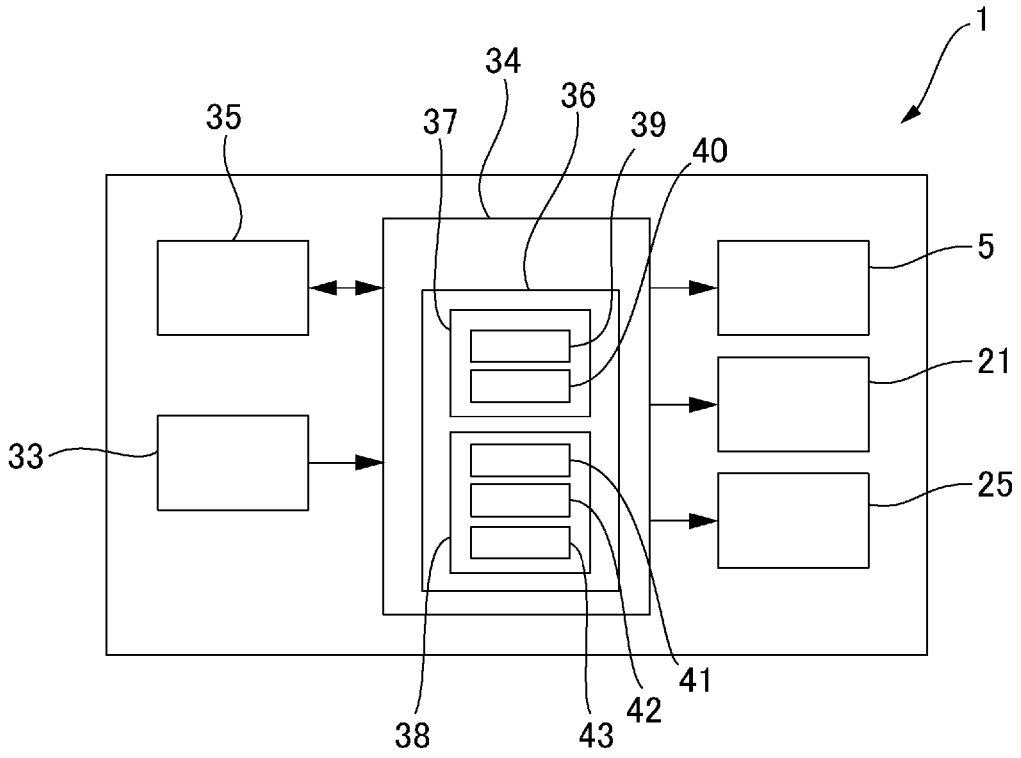
FIG. 3 is a basic block diagram of the control system of the printer shown in FIG. 1.

FIG. 3 is a block diagram showing main parts in the control system of the printer 1. The control system of the printer 1 is configured around a printer control unit 34 including a CPU and memory. A communication unit 35 that communicatively connects to an external device, and the detection unit 33 of the rotary encoder 31, are connected to the printer control unit 34. The printhead 5, conveyance motor 21, and supply motor 25 connect through drivers not shown to the output side of the printer control unit 34.

When print data is supplied from an external device through the communication unit 35, the printer control unit 34 controls driving the conveyance motor 21 and printhead 5 to print. More specifically, the printer control unit 34 controls driving the conveyance motor 21 to convey the recording paper 3 at a specific speed by means of the conveyance mechanism 12, and controls driving the printhead 5 to print the print data on the recording paper 3 while passing the print position A.

The printer control unit 34 also includes a supply motor drive control unit 36 that controls driving the supply motor 25. The supply motor drive control unit 36 includes a feedback control unit 37 and an error detection unit (error determination unit) 38.

The feedback control unit 37 includes a deviation acquisition unit 39 and a PID control unit 40. A value indicating the current position of the movable member 27 is input from the detection unit 33 to the deviation acquisition unit 39.

The deviation acquisition unit 39 subtracts the value indicating the current position of the movable member 27 from the value indicating the target position 27C on a predetermined specific period, and acquires the positional deviation. The value representing the target position 27C is previously stored in memory, for example. In this example, the period for determining the positional deviation is 1 ms.

The PID control unit 40 controls driving the supply motor 25 by controlling the duty of the PWM signal that drives the supply motor 25. Based on the positional deviation continuously acquired by the deviation acquisition unit 39, the PID control unit 40 applies feedback control to the supply motor 25 to reduce the positional deviation and return the movable member 27 to the target position 27C. More specifically, the supply motor drive control unit 36 drives the supply motor 25 by PID control to rotate the paper roll 2 while the conveyance mechanism 12 conveys the recording paper 3, and thereby delivers recording paper 3 from the paper roll 2 or rewinds the recording paper 3 onto the paper roll 2, sets the movable member 27 to the target position 27C, and suppresses variation in the tension on the recording paper 3.

The error detection unit 38 includes a movable member position determination unit 41, a clock unit 42, and a decision unit 43. The value indicating the current position of the movable member 27 is input from the detection unit 33 to the movable member position determination unit 41. The movable member position determination unit 41 then compares the value indicating the current position of the movable member 27 with values for the error determination ranges E1 and E2, and determines if the movable member 27 is in either of the error determination ranges E1 and E2. Values for the error determination ranges E1 and E2 are previously stored in memory, for example.

The clock unit 42 has a timer, and when the movable member position determination unit 41 determines the movable member 27 is in either of the error determination ranges E1 and E2, starts counting the time that the movable member 27 remains in the error determination range E1 or E2. More specifically, the clock unit 42 measures how long the movable member 27 is positioned in the error determination range E1 or E2.

If the measured time reaches a preset error determination time, the decision unit 43 determines there is an error. In this example, this error determination time is 5 ms or more and less than or equal to 5 seconds. The error detection unit 38 detects an error when the decision unit 43 determines there is an error.

When the error detection unit 38 detects an error, the supply motor drive control unit 36 stops supplying power to the supply motor 25 and stops the supply motor 25.

Printing Operation and Error Detection Operation

To print, the recording paper 3 is pulled up from the paper roll 2 on the roll paper spindle 24, passed around the slack roller 29 of the movable member 27 to the front, and then set in the paper conveyance path 8 passing the print position A. When print data is supplied from an external device with the recording paper 3 is loaded in the paper conveyance path 8, the printer control unit 34 drives the conveyance motor 21 to convey the recording paper 3 at a specific speed by means of the conveyance mechanism 12 and drives the printhead 5 to print the print data on the recording paper 3 as it passes the print position A.

While the recording paper 3 is being conveyed, the supply motor drive control unit 36 gets the positional deviation of the movable member 27 to the target position 27C, calculates the P (proportional) parameter, I (integral) parameter, and D (derivative) parameter based on the continuously acquired positional deviation, and drives the supply motor 25 by PID control. As a result, the supply motor drive control unit 36 suppresses variation in tension on the recording paper 3, and suppresses variation in the conveyance speed of the recording paper 3 due to change in the tension.

For example, when the recording paper 3 is pulled in the opposite direction as the conveyance direction D due to the inertia of the paper roll 2 while conveying the recording paper 3, the movable member 27 pivots from the target position 27C toward the tension limit position 27A. In this event, as shown in FIG. 2, the positional deviation increases in the positive (+) direction (the direction increasing tension), and the supply motor 25 is therefore driven so that recording paper 3 is delivered from the paper roll 2 in order to reduce the positional deviation. As a result, the movable member 27 returns to the target position 27C, and variation in the tension on the recording paper 3 is suppressed.

When the recording paper 3 is delivered in the conveyance direction D more quickly than the conveyance speed due to the inertia of the paper roll 2, for example, during conveyance of the recording paper 3, the movable member 27 pivots from the target position 27C toward the slack limit position 27B. In this event, as shown in FIG. 2, the positional deviation increases in the negative (−) direction (the direction decreasing tension), and the supply motor 25 is therefore driven so that recording paper 3 is taken up by the paper roll 2 in order to reduce the positional deviation. As a result, the movable member 27 returns to the target position 27C, and variation in the tension on the recording paper 3 is suppressed.

In this example, the supply motor 25 is controlled by the PID control unit 40 to quickly track displacement of the movable member 27. The movable member 27 therefore normally rocks through an angular range to the center of the target position 27C not reaching the error determination ranges E1 and E2.

Figure 4A:
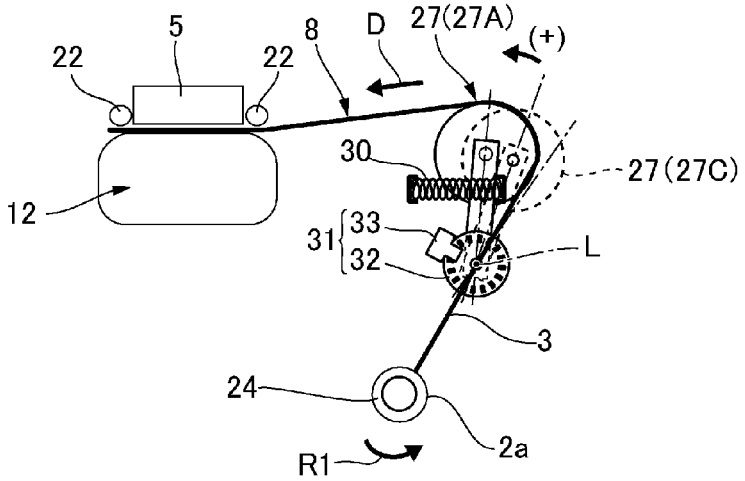
FIGS. 4A-4C illustrate when a no-paper error or a paper jam error occurs.
Figure 4B:
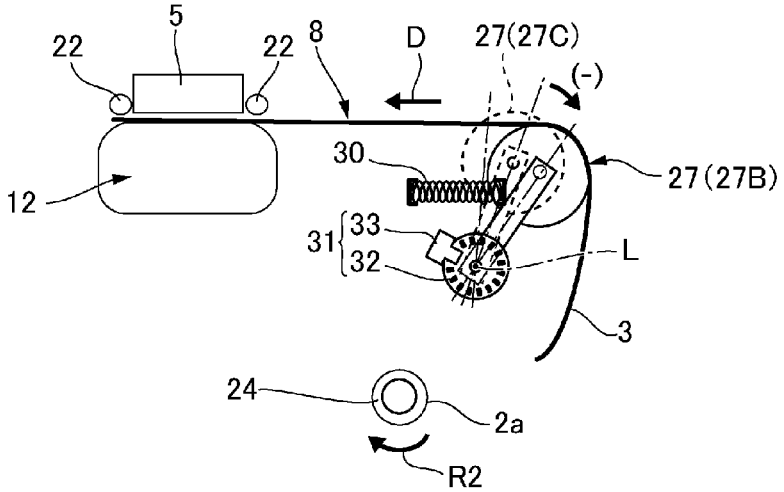
Figure 4C:
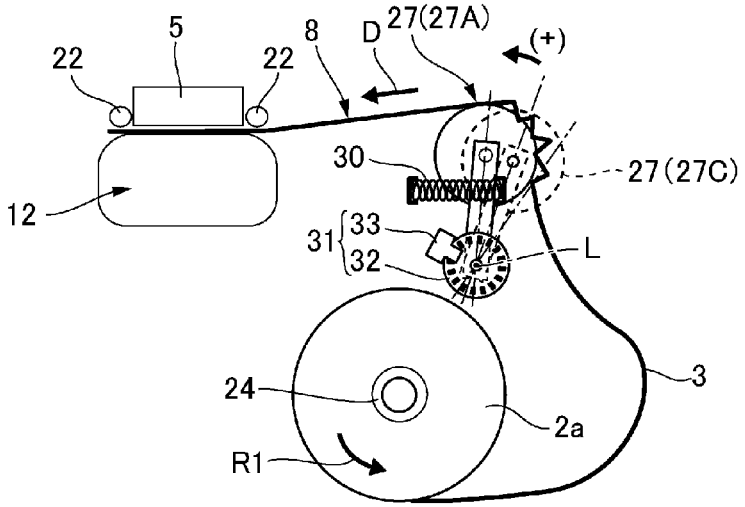
Figure 5:
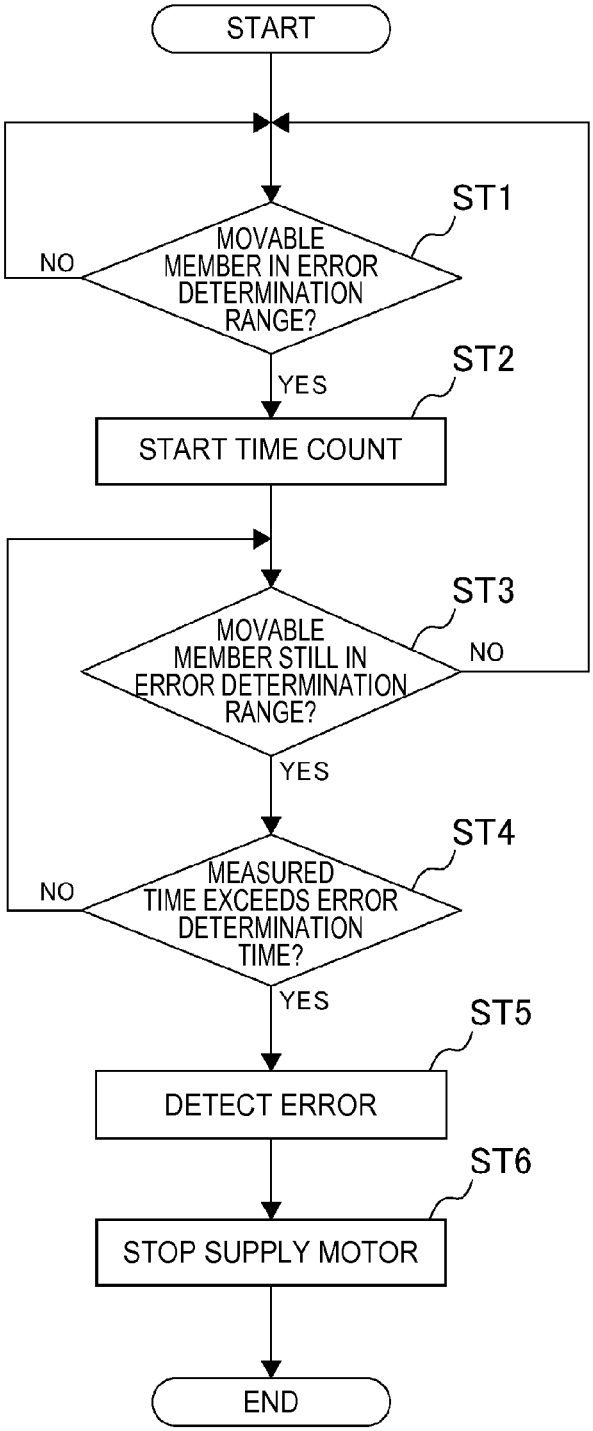
FIG. 5 is a flow chart of the error detection operation.

A no-paper error, which may occur when the recording paper 3 runs out, or a paper jam error, which may occur when the recording paper 3 jams, can occur while the recording paper 3 is being conveyed. FIGS. 4A-4C illustrate what happens when a no-paper error or a paper jam error occurs. FIG. 5 is a flow chart of the error detection operation.

For example, when printing with recording paper 3 that has the trailing end glued to the core 2*a* of the paper roll 2, the end of the recording paper 3 is reached, and a no-paper error occurs, the recording paper 3 will be pulled by the conveyance mechanism 12 in the conveyance direction D as shown in FIG. 4A, and the tension on the recording paper 3 becomes high. The recording paper 3 thus becomes locked and is not conveyed.

In this event, the movable member 27 pivots forward from the target position 27C to the tension limit position 27A. The movable member position determination unit 41 therefore determines that the movable member 27 is in the tension-side error determination range E1 (step ST1). When the movable member 27 is determined to be in the tension-side error determination range E1, the clock unit 42 starts counting how much time passes with the movable member 27 stopped in the tension-side error determination range E1 (step ST2).

When the movable member 27 is at the tension limit position 27A, the supply motor 25 is driven to rotate the paper roll 2 in the direction R1 delivering the recording paper 3 so that the movable member 27 returns to the target position 27C. However, because recording paper 3 is not delivered from the paper roll 2, the movable member 27 remains stuck at the tension limit position 27A. As a result, the time that the movable member 27 remains in the tension-side error determination range E1 exceeds the error determination time (steps ST3, ST4). The decision unit 43 therefore determines an error occurred.

As a result, the error detection unit 38 detects an error (step ST5).

When the error detection unit 38 detects an error, the supply motor drive control unit 36 stops supplying power to the supply motor 25, and the supply motor 25 stops (step ST6). If the power supply to the supply motor 25 is not stopped, too much power is supplied to the media supply motor in order to return the movable member 27 to the target position 27C and the supply motor 25 may overheat, but this is avoided by the configuration of this embodiment.

In addition, when printing with recording paper 3 that does not have the trailing end glued to the core 2*a* of the paper roll 2, the end of the recording paper 3 is reached, and a no-paper error occurs, the recording paper 3 will unravel from the core 2*a* of the paper roll 2 near the trailing end of the recording paper 3 as shown in FIG. 4B. As a result, the force pulling the recording paper 3 in the opposite direction as the conveyance direction D disappears, and the tension on the recording paper 3 goes to zero.

In this event, the movable member 27 pivots to the back from the target position 27C and goes to the slack limit position 27B. The movable member position determination unit 41 therefore determines that the movable member 27 is at the slack-side error determination range E2 (step ST1). When the movable member 27 is determined to be in the slack-side error determination range E2, the clock unit 42 starts counting the time that the movable member 27 is stopped in the slack-side error determination range E2 (step ST2).

When the movable member 27 is at the slack limit position 27B, the supply motor 25 is driven to rotate the paper roll 2 in the direction R2 that rewinds the recording paper 3 to return the movable member 27 to the target position 27C. However, because the recording paper 3 is not taken up by the paper roll 2, the movable member 27 remains stuck at the slack limit position 27B. As a result, the time that the movable member 27 remains in the slack-side error determination range E2 exceeds the error determination time (steps ST3, ST4). The decision unit 43 therefore determines an error occurred.

As a result, the error detection unit 38 detects an error (step ST5).

When the error detection unit 38 detects an error, the supply motor drive control unit 36 stops supplying power to the supply motor 25, and stops the supply motor 25 (step ST6). If the power supply to the supply motor 25 is not stopped, too much power is supplied to the media supply motor in order to return the movable member 27 to the target position 27C and the supply motor 25 may overheat, but this is avoided by the configuration of this embodiment.

If the recording paper 3 jams while the recording paper 3 is being conveyed, causing a paper jam error in which the recording paper 3 cannot be conveyed, the part of the recording paper 3 that caused the paper jam pushes the movable member 27 to the tension limit position 27A as shown in FIG. 4C.

In this event, the movable member position determination unit 41 determines that the movable member 27 is in the tension-side error determination range E1 (step ST1). When the movable member 27 is determined to be in the tension-side error determination range E1, the clock unit 42 starts counting how much time passes with the movable member 27 stopped in the tension-side error determination range E1 (step ST2).

When the movable member 27 is at the tension limit position 27A, the supply motor 25 is driven to rotate the paper roll 2 in the direction R1 delivering the recording paper 3 so that the movable member 27 returns to the target position 27C. However, because recording paper 3 is not delivered from the paper roll 2, the movable member 27 remains stuck at the tension limit position 27A by the part of the recording paper 3 that caused the paper jam. As a result, the time that the movable member 27 remains in the tension-side error determination range E1 exceeds the error determination time (steps ST3, ST4). The decision unit 43 therefore determines an error occurred, and the error detection unit 38 detects an error (step ST5).

When the error detection unit 38 detects an error, the supply motor drive control unit 36 stops supplying power to the supply motor 25, and the supply motor 25 stops (step ST6). If the power supply to the supply motor 25 is not stopped, too much power is supplied to the media supply motor in order to return the movable member 27 to the target position 27C and the supply motor 25 may overheat, but this is avoided by the configuration of this embodiment. In addition, if the power supply to the supply motor 25 is not stopped, recording paper 3 will continue being delivered from the paper roll, but this embodiment of the invention also prevents this from happening.

Vibration in the printer 1 while the recording paper 3 is being conveyed may also cause the movable member 27 to temporarily swing into the error determination ranges E1 and E2. The movable member 27 may also swing into the error determination ranges E1 and E2 when the part of the recording paper 3 wound onto the paper roll 2 momentarily does not peel away from the paper roll 2. In this example, however, the error detection unit 38 detects errors based on how long the movable member 27 remains in the error determination ranges E1 and E2. An error is therefore not detected as a result of the movable member 27 momentarily moving into the error determination ranges E1 and E2.

Effect of the Invention

Because this embodiment of the invention detects errors based on the position of a movable member 27 that can move following change in the tension on the recording paper 3, errors in the conveyance and recording paper 3 delivered from a paper roll 2 can be detected without providing a dedicated sensor for detecting a no-paper error or paper jam error.

In this embodiment of the invention, the period for acquiring the positional deviation is 1 ms, and the error determination time is 5 ms or more and 5 s or less. Errors can therefore be detected in a relatively short time. The supply motor 25 can therefore be prevented from overheating by stopping the supply motor 25 after an error is detected.

The movable member 27 in this embodiment of the invention pivots around an axis of rotation L, but a configuration in which the movable member 27 moves linearly following change in the tension on the recording paper 3 is also conceivable.

Furthermore, the target position 27C of the movable member 27 is set in the middle of the allowable movement range E0 of the movable member 27 in the embodiment described above, but the target position 27C could alternatively be set at one end of the direction in which the movable member 27 moves in the allowable movement range E0. In this configuration, the error determination range could be set to include the other end of the direction of movement of the movable member 27 in the allowable movement range E0, for example.

Yet further, the conveyance mechanism 12 in the above example drives the conveyance belt 15 by the conveyance motor 21 to convey the recording paper 3, but the conveyance mechanism could alternatively convey the recording paper by driving a conveyance roller by means of the conveyance motor. Yet further, the PID control unit 40 drives the supply motor 25 by PID control, but the PID control unit 40 may drive the supply motor 25 by PD control or PI control.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A media conveyance control method of a media conveyance device having a conveyance mechanism that conveys a continuous medium delivered from a roll, and a media supply motor that rotates the roll, comprising:

positioning a movable member that moves in response to a change in the tension on the medium between the roll and the conveyance mechanism;

setting a target position and an error determination range separated from the target position in the movable range of the movable member;

acquiring a positional deviation of the movable member from the target position continuously or intermittently while conveying the medium by the conveyance mechanism;

controlling driving the media supply motor based on the positional deviation to set the movable member to the target position;

measuring the time the movable member remains in the error determination range after the movable member enters the error determination range; and determining if an error occurred based on the measured time.

2. The media conveyance control method described in claim 1, wherein:

the error determination range is set to an end part of the direction of movement of the movable member in the movable range.

3. The media conveyance control method described in claim 1, further comprising:

presetting an error determination time; and determining an error occurred when the measured time reaches the error determination time.

4. The media conveyance control method described in claim 3, wherein:

the error determination time is set to greater than or equal to 5 ms and less than or equal to 5 s.

5. A printer comprising:

a conveyance mechanism that conveys a continuous medium delivered from a roll;

a media supply motor that rotates the roll;

a movable member disposed movably between the roll and the conveyance mechanism following change in the tension on the medium;

a detector configured to detect the position of the movable member;

a control unit that continuously or intermittently acquires the positional deviation of the movable member to a target position set in the movable range of the movable member while conveying the medium by the conveyance mechanism, and controls driving the media supply motor based on the positional deviation to set the movable member to the target position;

a movable member position determination unit configured to determine if the position of the movable member is in an error determination range set to a position in the movable range separated from the target position while the medium is being conveyed by the conveyance mechanism;

a clock unit that measures the time the position of the movable member is in the error determination range; and an error determination unit configured to determine if an error occurred based on the measured time.

6. The printer described in claim 5, wherein:

the error determination range is set to an end part of the direction of movement of the movable member in the movable range.

7. The printer described in claim 5, wherein:

the error determination unit determines an error occurred when the measured time reaches a previously set error determination time.

8. The printer described in claim 7, wherein:

the error determination time is set to greater than or equal to 5 ms and less than or equal to 5 s.

* * * * *